US006991047B2

(12) United States Patent
Zupanick

(10) Patent No.: US 6,991,047 B2
(45) Date of Patent: Jan. 31, 2006

(54) WELLBORE SEALING SYSTEM AND METHOD

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 156 days.

(21) Appl. No.: 10/194,368

(22) Filed: Jul. 12, 2002

(65) Prior Publication Data

US 2004/0007389 A1 Jan. 15, 2004

(51) Int. Cl.
*E21B 7/06* (2006.01)

(52) U.S. Cl. ..... 175/61; 175/75; 166/117.6

(58) Field of Classification Search ..... 175/61, 175/62, 73, 74, 75; 166/117.6
See application file for complete search history.

(56) References Cited

U.S. PATENT DOCUMENTS

| | | | |
|---|---|---|---|
| 54,144 | A | 4/1866 | Hamar |
| 274,740 | A | 3/1883 | Douglass |
| 526,708 | A | 10/1894 | Horton |
| 639,036 | A | 12/1899 | Heald |
| 1,189,560 | A | 7/1916 | Gondos |
| 1,285,347 | A | 11/1918 | Otto |
| 1,467,480 | A | 9/1923 | Hogue |
| 1,485,615 | A | 3/1924 | Jones |

(Continued)

FOREIGN PATENT DOCUMENTS

| | | |
|---|---|---|
| AU | 85/49964 A | 11/1986 |
| CA | 2210866 | 1/1998 |
| CA | 2278735 | 8/1998 |
| CH | 653741 A5 | 1/1986 |
| DE | 197 25 996 | 1/1998 |
| EP | 0 819 834 | 1/1998 |
| EP | 0 875 661 A1 | 11/1998 |
| EP | 0 952 300 A1 | 10/1999 |

(Continued)

OTHER PUBLICATIONS

Chi, Weiguo, "*A feasible discussion on exploitation coalbed methane through horizontal network drilling in China*," SPE 64709, Society of Petroleum Engineers (SPE International), Nov. 7, 2000, 4 pages.

Notification of Transmittal of the International Search Report or the Declaration (PCT Rule 44.1) (3 pages) and International Search Report (3 pages) re International Application No. PCT/US 03/28137 mailed Dec. 19, 2003.

Notification of Transmittal of the International Search Report or the Declaration (PCT Rule 44.1) (3 pages) and International Search Report (5 pages) re International Application No. PCT/US 03/26124 mailed Feb. 4, 2004.

(Continued)

*Primary Examiner*—Frank Tsay
(74) *Attorney, Agent, or Firm*—Fish & Richardson P.C.

(57) ABSTRACT

In accordance with one embodiment of the present invention, a method for drilling wellbores includes drilling a main wellbore and disposing a casing string in the main wellbore. The casing string has a deflecting member and a sealing member coupled thereto. The method further includes disposing a drill string having a drill bit coupled at a lower end thereof in the casing string and drilling, from the main wellbore, a first lateral wellbore at a first depth with the drill bit. The method further includes removing the drill bit from the first lateral wellbore, transferring the casing string and the drill bit to a second depth that is higher than the first depth, drilling, from the main wellbore, a second lateral wellbore at the second depth with the drill bit, and preventing, using the sealing member, a fluid from the first lateral wellbore from flowing above approximately the second depth while drilling the second lateral wellbore.

20 Claims, 3 Drawing Sheets

U.S. PATENT DOCUMENTS

| | | | | |
|---|---|---|---|---|
| 1,488,106 | A | 3/1924 | Fitzpatrick | |
| 1,520,737 | A | 12/1924 | Wright | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Boll et al. | 255/24 |
| 2,335,085 | A | 11/1943 | Roberts | 251/197 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,726,063 | A | 12/1955 | Ragland et al. | 255/1.8 |
| 2,726,847 | A | 12/1955 | McCune et al. | 255/1.6 |
| 2,783,018 | A | 2/1957 | Lytle | 251/25 |
| 2,797,893 | A | 7/1957 | McCune et al. | |
| 2,847,189 | A | 8/1958 | Shook | 255/76 |
| 2,911,008 | A | 11/1959 | Du Bois | 137/625.31 |
| 2,980,142 | A | 4/1961 | Turak | 137/637.3 |
| 3,163,211 | A | 12/1964 | Henley | |
| 3,208,537 | A | 9/1965 | Scarborough | 175/53 |
| 3,347,595 | A | 10/1967 | Dahms et al. | 299/4 |
| 3,385,382 | A | 5/1968 | Canalizo et al. | |
| 3,443,648 | A | 5/1969 | Howard | 175/103 |
| 3,473,571 | A | 10/1969 | Dugay | 137/625.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,578,077 | A | 5/1971 | Glenn, Jr. et al. | |
| 3,582,138 | A | 6/1971 | Loofbourow et al. | |
| 3,587,743 | A | 6/1971 | Howard | |
| 3,684,041 | A | 8/1972 | Kammerer, Jr. et al. | 175/267 |
| 3,692,041 | A | 9/1972 | Bondi | 137/238 |
| 3,744,565 | A | 7/1973 | Brown | |
| 3,757,876 | A | 9/1973 | Pereau | 175/267 |
| 3,757,877 | A | 9/1973 | Leathers | 175/269 |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,907,045 | A | 9/1975 | Dahl et al. | 175/45 |
| 3,934,649 | A | 1/1976 | Pasini, III et al. | 166/254 |
| 3,957,082 | A | 5/1976 | Fuson et al. | 137/625.41 |
| 3,961,824 | A | 6/1976 | Van Eek et al. | 299/17 |
| 4,011,890 | A | 3/1977 | Andersson | 137/625.4 |
| 4,020,901 | A | 5/1977 | Pisio et al. | |
| 4,022,279 | A | 5/1977 | Driver | 166/271 |
| 4,030,310 | A | 6/1977 | Schirtzinger | |
| 4,037,658 | A | 7/1977 | Anderson | 166/272 |
| 4,060,130 | A | 11/1977 | Hart | |
| 4,073,351 | A | 2/1978 | Baum | 175/14 |
| 4,089,374 | A | 5/1978 | Terry | 166/259 |
| 4,116,012 | A | 9/1978 | Abe et al. | 405/238 |
| 4,134,463 | A | 1/1979 | Allen | 175/53 |
| 4,136,996 | A | 1/1979 | Burns | |
| 4,151,880 | A | 5/1979 | Vann | |
| 4,156,437 | A | 5/1979 | Chivens et al. | 137/554 |
| 4,169,510 | A | 10/1979 | Meigs | 175/65 |
| 4,182,423 | A * | 1/1980 | Ziebarth et al. | 175/61 |
| 4,189,184 | A | 2/1980 | Green | 299/8 |
| 4,220,203 | A | 9/1980 | Steeman | 166/271 |
| 4,221,433 | A | 9/1980 | Jacoby | 299/4 |
| 4,222,611 | A | 9/1980 | Larson et al. | |
| 4,224,989 | A | 9/1980 | Blount | 166/250 |
| 4,226,475 | A | 10/1980 | Frosch et al. | |
| 4,257,650 | A | 3/1981 | Allen | 299/2 |
| 4,278,137 | A | 7/1981 | Van Eek | 175/267 |
| 4,283,088 | A | 8/1981 | Tabakov et al. | 299/2 |
| 4,296,785 | A | 10/1981 | Vitello et al. | 141/105 |
| 4,299,295 | A | 11/1981 | Gossard | 175/45 |
| 4,303,127 | A | 12/1981 | Freel et al. | 166/266 |
| 4,305,464 | A | 12/1981 | Masszi | 166/370 |
| 4,312,377 | A | 1/1982 | Knecht | 137/625.19 |
| 4,317,492 | A | 3/1982 | Summers et al. | 175/79 |
| 4,328,577 | A | 5/1982 | Abbott et al. | 370/84 |
| 4,333,539 | A | 6/1982 | Lyons et al. | |
| 4,366,988 | A | 1/1983 | Bodine | 299/14 |
| 4,372,398 | A | 2/1983 | Kuckes | 175/45 |
| 4,386,665 | A | 6/1983 | Dellinger | 175/61 |
| 4,390,067 | A | 6/1983 | Willman | 166/245 |
| 4,396,076 | A | 8/1983 | Inoue | 175/265 |
| 4,397,360 | A | 8/1983 | Schmidt | 175/61 |
| 4,401,171 | A | 8/1983 | Fuchs | 175/267 |
| 4,407,376 | A | 10/1983 | Inoue | 175/267 |
| 4,415,205 | A | 11/1983 | Rehm et al. | |
| 4,417,829 | A | 11/1983 | Berezoutzky | |
| 4,422,505 | A | 12/1983 | Collins | |
| 4,437,706 | A | 3/1984 | Johnson | 299/7 |
| 4,442,896 | A | 4/1984 | Reale et al. | 166/278 |
| 4,463,988 | A | 8/1984 | Bouck et al. | |
| 4,494,616 | A | 1/1985 | McKee | 175/67 |
| 4,502,733 | A | 3/1985 | Grubb | |
| 4,512,422 | A | 4/1985 | Knisley | 175/99 |
| 4,519,463 | A | 5/1985 | Schuh | 175/61 |
| 4,527,639 | A | 7/1985 | Dickinson, III et al. | 175/61 |
| 4,532,986 | A | 8/1985 | Mims et al. | 166/50 |
| 4,533,182 | A | 8/1985 | Richards | |
| 4,536,035 | A | 8/1985 | Huffman et al. | |
| 4,544,037 | A | 10/1985 | Terry | 166/369 |
| 4,558,744 | A | 12/1985 | Gibb | 166/335 |
| 4,565,252 | A | 1/1986 | Campbell et al. | 175/269 |
| 4,573,541 | A | 3/1986 | Josse et al. | 175/78 |
| 4,599,172 | A | 7/1986 | Gardes | 210/314 |
| 4,600,061 | A | 7/1986 | Richards | 175/62 |
| 4,603,592 | A | 8/1986 | Siebold et al. | |
| 4,605,076 | A | 8/1986 | Goodhart | 175/61 |
| 4,611,855 | A | 9/1986 | Richards | 299/2 |
| 4,618,009 | A | 10/1986 | Carter et al. | 175/267 |
| 4,638,949 | A | 1/1987 | Mancel | 239/307 |
| 4,646,836 | A | 3/1987 | Goodhart | 166/303 |
| 4,651,836 | A | 3/1987 | Richards | |
| 4,674,579 | A | 6/1987 | Geller et al. | 175/45 |
| 4,676,313 | A | 6/1987 | Rinaldi | |
| 4,702,314 | A | 10/1987 | Huang et al. | 166/245 |
| 4,705,109 | A | 11/1987 | Ledent et al. | |
| 4,705,431 | A | 11/1987 | Gadelle et al. | 405/267 |
| 4,715,440 | A | 12/1987 | Boxell et al. | 166/100 |
| 4,718,485 | A | 1/1988 | Brown et al. | |
| 4,727,937 | A | 3/1988 | Shum et al. | |
| 4,753,485 | A | 6/1988 | Goodhart | |
| 4,754,819 | A | 7/1988 | Dellinger | 175/61 |
| 4,756,367 | A | 7/1988 | Puri et al. | 166/263 |
| 4,763,734 | A | 8/1988 | Dickinson et al. | 175/61 |
| 4,773,488 | A | 9/1988 | Bell et al. | 175/61 |
| 4,776,638 | A | 10/1988 | Hahn | |
| 4,830,105 | A | 5/1989 | Petermann | 166/241 |
| 4,832,122 | A | 5/1989 | Corey et al. | |
| 4,836,611 | A | 6/1989 | El-Saie | 299/7 |
| 4,842,081 | A | 6/1989 | Parant | 175/23 |
| 4,844,182 | A | 7/1989 | Tolle | 175/215 |
| 4,852,666 | A | 8/1989 | Brunet et al. | 175/61 |
| 4,883,122 | A | 11/1989 | Puri et al. | 166/248 |
| 4,889,186 | A | 12/1989 | Hanson et al. | |
| 4,978,172 | A | 12/1990 | Schwoebel et al. | 299/12 |
| 5,016,709 | A | 5/1991 | Combe et al. | |
| 5,016,710 | A | 5/1991 | Renard et al. | 166/245 |
| 5,033,550 | A | 7/1991 | Johnson et al. | |
| 5,035,605 | A | 7/1991 | Dinerman et al. | 481/18 |

5,036,921 A 8/1991 Pittard et al. ..... 166/298
5,074,360 A 12/1991 Guinn ..... 166/281
5,074,365 A 12/1991 Kuckes ..... 175/40
5,074,366 A 12/1991 Karlsson et al. ..... 175/76
5,082,054 A 1/1992 Kiamanesh ..... 166/248
5,111,893 A 5/1992 Kvello-Aune ..... 175/258
5,115,872 A 5/1992 Brunet et al.
5,121,244 A 6/1992 Takasaki
5,127,457 A 7/1992 Stewart et al.
5,135,058 A 8/1992 Millgard et al. ..... 175/71
5,148,875 A 9/1992 Karlsson et al. ..... 175/62
5,148,877 A 9/1992 MacGregor
5,165,491 A 11/1992 Wilson ..... 175/62
5,168,942 A 12/1992 Wydrinski ..... 175/50
5,174,374 A 12/1992 Hailey ..... 166/55.8
5,193,620 A 3/1993 Braddick ..... 166/382
5,194,859 A 3/1993 Warren ..... 340/853.4
5,194,977 A 3/1993 Nishio
5,197,553 A 3/1993 Leturno ..... 175/57
5,197,783 A 3/1993 Theimer et al. ..... 299/17
5,199,496 A 4/1993 Redus et al. ..... 166/366
5,201,817 A 4/1993 Hailey ..... 175/269
5,217,076 A 6/1993 Masek ..... 166/303
5,226,495 A 7/1993 Jennings, Jr. ..... 166/278
5,240,350 A 8/1993 Yamaguchi et al. ..... 405/143
5,242,017 A 9/1993 Hailey ..... 166/55.8
5,242,025 A 9/1993 Neill et al. ..... 175/26
5,246,273 A 9/1993 Rosar ..... 299/4
5,255,741 A 10/1993 Alexander ..... 166/278
5,271,472 A 12/1993 Leturno ..... 175/107
5,287,926 A 2/1994 Grupping
5,289,888 A 3/1994 Talley
5,301,760 A 4/1994 Graham ..... 175/61
5,343,965 A 9/1994 Talley et al.
5,355,967 A 10/1994 Mueller et al.
5,363,927 A 11/1994 Frank ..... 175/67
5,385,205 A 1/1995 Hailey ..... 166/55.8
5,394,950 A 3/1995 Gardes ..... 175/45
5,402,851 A 4/1995 Baiton ..... 166/369
5,411,082 A 5/1995 Kennedy ..... 166/181
5,411,085 A 5/1995 Moore et al. ..... 166/242
5,411,088 A 5/1995 LeBlanc et al.
5,411,104 A 5/1995 Stanley ..... 175/65
5,411,105 A 5/1995 Gray ..... 175/69
5,431,220 A 7/1995 Lennon et al. ..... 166/55.7
5,431,482 A 7/1995 Russo
5,435,400 A 7/1995 Smith ..... 175/61
5,447,416 A 9/1995 Wittrisch ..... 417/442
5,450,902 A 9/1995 Matthews ..... 166/268
5,454,419 A 10/1995 Vloedman ..... 166/277
5,458,209 A 10/1995 Hayes et al. ..... 175/61
5,462,116 A 10/1995 Carroll ..... 166/249
5,462,120 A 10/1995 Gondouin ..... 166/380
5,469,155 A 11/1995 Archambeault et al. . 340/853.4
5,477,923 A 12/1995 Jordan, Jr. et al. ..... 66/313
5,485,089 A 1/1996 Kuckes ..... 324/346
5,494,121 A 2/1996 Nackerud ..... 175/263
5,499,687 A 3/1996 Lee ..... 175/317
5,501,273 A 3/1996 Puri ..... 166/252.5
5,501,279 A 3/1996 Garg et al. ..... 166/372
5,584,605 A 12/1996 Beard et al. ..... 405/128
5,613,242 A 3/1997 Oddo ..... 588/17
5,615,739 A 4/1997 Dallas ..... 166/306
5,653,286 A 8/1997 McCoy et al.
5,659,347 A 8/1997 Taylor
5,669,444 A 9/1997 Riese et al. ..... 166/263
5,676,207 A 10/1997 Simon et al.
5,680,901 A 10/1997 Gardes ..... 166/313
5,690,390 A 11/1997 Bithell ..... 299/4
5,697,445 A 12/1997 Graham
5,706,871 A 1/1998 Andersson et al. ..... 141/59
5,720,356 A 2/1998 Gardes ..... 175/62
5,727,629 A 3/1998 Blizzard, Jr. et al. ..... 166/298
5,735,350 A 4/1998 Longbottom et al. ..... 166/313
5,771,976 A 6/1998 Talley ..... 166/370
5,775,433 A 7/1998 Hammett et al.
5,775,443 A 7/1998 Lott
5,785,133 A 7/1998 Murray et al. ..... 175/61
5,832,958 A 11/1998 Cheng ..... 137/625.41
5,852,505 A 12/1998 Li
5,853,054 A 12/1998 McGarian et al. ..... 175/267
5,853,056 A 12/1998 Landers ..... 175/424
5,853,224 A 12/1998 Riese ..... 299/13
5,863,283 A 1/1999 Gardes ..... 588/250
5,867,289 A 2/1999 Gerstel et al.
5,868,202 A 2/1999 Hsu ..... 166/256
5,868,210 A 2/1999 Johnson et al. ..... 175/40
5,879,057 A 3/1999 Schwoebel et al. ..... 299/17
5,884,704 A 3/1999 Longbottom et al. ..... 16/313
5,912,754 A 6/1999 Koga et al.
5,914,798 A 6/1999 Liu
5,917,325 A 6/1999 Smith ..... 324/326
5,934,390 A 8/1999 Uthe ..... 175/67
5,938,004 A 8/1999 Roberts et al. ..... 198/812
5,941,307 A 8/1999 Tubel
5,941,308 A 8/1999 Malone et al. ..... 166/313
5,944,107 A 8/1999 Ohmer
5,957,539 A 9/1999 Durup et al. ..... 299/4
5,971,074 A 10/1999 Longbottom et al. ..... 166/313
5,988,278 A 11/1999 Johnson
5,992,524 A 11/1999 Graham
6,012,520 A 1/2000 Yu et al. ..... 166/245
6,015,012 A 1/2000 Reddick
6,019,173 A * 2/2000 Saurer et al. ..... 166/98
6,024,171 A 2/2000 Montgomery et al. ..... 166/308
6,030,048 A 2/2000 Hsu
6,050,335 A 4/2000 Parsons ..... 166/272.3
6,056,059 A 5/2000 Ohmer ..... 166/313
6,062,306 A * 5/2000 Gano et al. ..... 166/50
6,065,550 A 5/2000 Gardes ..... 175/62
6,065,551 A 5/2000 Gourley et al.
6,079,495 A 6/2000 Ohmer
6,089,322 A 7/2000 Kelley et al.
6,119,771 A 9/2000 Gano et al. ..... 166/50
6,119,776 A 9/2000 Graham et al.
6,135,208 A 10/2000 Gano et al. ..... 166/313
6,170,571 B1 1/2001 Ohmer
6,179,054 B1 1/2001 Stewart
6,179,659 B1 * 1/2001 Moden ..... 439/590
6,189,616 B1 * 2/2001 Gano et al. ..... 166/298
6,192,988 B1 2/2001 Tubel
6,199,633 B1 3/2001 Longbottom
6,209,636 B1 4/2001 Roberts et al.
6,237,284 B1 5/2001 Erickson
6,244,340 B1 * 6/2001 McGlothen et al. ..... 166/255.3
6,247,532 B1 6/2001 Ohmer
6,263,965 B1 7/2001 Schmidt et al.
6,279,658 B1 8/2001 Donovan et al.
6,280,000 B1 8/2001 Zupanick ..... 299/12
6,283,216 B1 9/2001 Ohmer
6,318,457 B1 11/2001 Den Boer et al.
6,349,769 B1 2/2002 Ohmer ..... 166/313
6,357,523 B1 3/2002 Zupanick ..... 166/52
6,357,530 B1 3/2002 Kennedy et al.
6,425,448 B1 7/2002 Zupanick et al. ..... 175/61
6,439,320 B2 8/2002 Zupanick ..... 175/161
6,450,256 B2 9/2002 Mones
6,454,000 B1 9/2002 Zupanick
6,457,540 B2 10/2002 Gardes
6,491,101 B2 12/2002 Ohmer
6,497,556 B2 12/2002 Zupanick
6,554,063 B2 4/2003 Ohmer

| | | | | |
|---|---|---|---|---|
| 6,557,628 | B2 | 5/2003 | Ohmer | |
| 6,564,867 | B2 | 5/2003 | Ohmer | |
| 6,566,649 | B1 | 5/2003 | Mickael | 250/269.3 |
| 6,571,888 | B2 | 6/2003 | Comeau et al. | 175/61 |
| 6,577,129 | B1 | 6/2003 | Thompson et al. | 324/338 |
| 6,585,061 | B2 | 7/2003 | Radzinski et al. | 175/45 |
| 6,590,202 | B2 | 7/2003 | Mickael | 250/269.2 |
| 6,591,903 | B2 | 7/2003 | Ingle et al. | 166/50 |
| 6,598,686 | B1 | 7/2003 | Zupanick | 175/62 |
| 6,604,910 | B1 | 8/2003 | Zupanick | |
| 6,607,042 | B2 | 8/2003 | Hoyer et al. | 175/38 |
| 6,636,159 | B1 | 10/2003 | Winnacker | 340/854.3 |
| 6,639,210 | B2 | 10/2003 | Odom et al. | 250/269.6 |
| 6,646,411 | B2 | 11/2003 | Hirono et al. | 324/338 |
| 6,646,441 | B2 | 11/2003 | Thompson et al. | |
| 6,653,839 | B2 | 11/2003 | Yuratich et al. | 324/355 |
| 6,679,322 | B1 | 1/2004 | Zupanick | |
| 6,725,922 | B2 | 4/2004 | Zupanick | |
| 6,758,279 | B2 | 7/2004 | Moore et al. | |
| 2002/0043404 | A1 | 4/2002 | Trueman et al. | |
| 2002/0050358 | A1 | 5/2002 | Algeroy et al. | |
| 2002/0074120 | A1 | 6/2002 | Scott | 166/313 |
| 2002/0108746 | A1 | 8/2002 | Zupanick et al. | 166/50 |
| 2002/0117297 | A1 | 8/2002 | Zupanick | 166/50 |
| 2002/0189801 | A1 | 12/2002 | Zupanick et al. | 166/50 |
| 2003/0062198 | A1 | 4/2003 | Gardes | 175/61 |
| 2003/0066686 | A1 | 4/2003 | Conn | 175/57 |
| 2003/0075334 | A1 | 4/2003 | Haugen et al. | 166/313 |
| 2003/0164253 | A1 | 9/2003 | Trueman et al. | |
| 2003/0217842 | A1 | 11/2003 | Zupanick | |
| 2003/0221836 | A1 | 12/2003 | Gardes | |
| 2004/0007389 | A1 | 1/2004 | Zupanick | |
| 2004/0011560 | A1 | 1/2004 | Rial et al. | |
| 2004/0020655 | A1 | 2/2004 | Rusby et al. | |
| 2004/0031609 | A1 | 2/2004 | Zupanick | |
| 2004/0033557 | A1 | 2/2004 | Scott et al. | |
| 2004/0035582 | A1 | 2/2004 | Zupanick | |
| 2004/0050552 | A1 | 3/2004 | Zupanick | |
| 2004/0050554 | A1 | 3/2004 | Zupanick | |
| 2004/0055787 | A1 | 3/2004 | Zupanick | |
| 2004/0060351 | A1 | 4/2004 | Gunter et al. | |
| 2004/0140129 | A1 | 7/2004 | Gardes | |
| 2004/0226719 | A1 | 11/2004 | Morgan et al. | |

FOREIGN PATENT DOCUMENTS

| | | | | |
|---|---|---|---|---|
| FR | 964503 | | 4/1944 | 8/1 |
| GB | 422008 | | 1/1936 | |
| GB | 444484 | | 3/1936 | |
| GB | 651468 | | 4/1951 | |
| GB | 893869 | | 4/1962 | |
| GB | SU-750108 | | 6/1975 | |
| GB | SU-1448078 | A1 | 3/1987 | |
| GB | SU-1770570 | A1 | 3/1990 | |
| GB | 2 255 033 | A | 10/1992 | |
| GB | 2 297 988 | | 8/1996 | |
| GB | 2 347 157 | A | 8/2000 | |
| RU | SU-750108 | | 6/1975 | |
| RU | SU-876968 | | 10/1981 | |
| RU | SU-1448078 | A1 | 3/1987 | |
| RU | SU-1770570 | A1 | 3/1990 | |
| WO | 94/21889 | | 9/1994 | |
| WO | WO 97/21900 | | 6/1997 | |
| WO | WO 98/25005 | | 6/1998 | |
| WO | WO 98/35133 | | 8/1998 | |
| WO | WO 99/60248 | | 11/1999 | |
| WO | 00/31376 | | 6/2000 | |
| WO | WO 00/79099 | | 12/2000 | |
| WO | WO 01/44620 | A1 | 6/2001 | |
| WO | WO 02/18738 | | 3/2002 | |
| WO | WO 02/059455 | | 8/2002 | |
| WO | WO 02/061238 | | 8/2002 | |
| WO | WO 03/102348 | | 12/2003 | |
| WO | WO 03/102348 | A2 | 12/2003 | |
| WO | WO 2004/035984 | | 4/2004 | |
| WO | WO 2005/003509 | A1 | 1/2005 | |

OTHER PUBLICATIONS

Jet Lavanway Exploration, "*Well Survey*," Key Energy Surveys, 3 pages, Nov. 2, 1997.

Precision Drilling, "*We Have Roots in Coal Bed Methane Drilling*," Technology Services Group, 1 page, Published on or before Aug. 5, 2002.

Smith, Maurice, "*Unconventional Wisdom*," CBM Gas Technology, New Technology Magazine, Oct.–Nov. 2003, 5 pages.

U.S. Dept. of Energy, "*New Breed of CBM/CMM Recovery Technology*," 1 page, Jul. 2003.

Dick Ghiselin, "Unconventional Vision Frees Gas Reserves," Natural Gas Quarterly, 2 pages, Sep. 2003.

CBM Review, World Coal, "*US Drilling into Asia*," 4 pages, Jun. 2003.

Chris Skrebowski, "*US Interest in North Korean Reserves*," Petroleum, Energy Institute, 4 pages, Jul. 2003.

Notification of Transmittal of the International Search Report or the Declaration (PCT Rule 44.1) (3 pages) and International Search Report (4 pages) re International Application No. PCT/US 03/38383 mailed Jun. 2, 2004.

Palmer, Ian D., et al., "*Coalbed Methane Well Completions and Stimulations*" Chapter 14, Hydrocarbons From Coal, American Association of Petroleum Geologists, 1993, pp. 303–339.

Zupanick, U.S. Patent Application entitled "Method and System for Controlling Pressure in a Dual Well System," U.S. Appl. No. 10/244,082, filed Sep. 12, 2002.

Diamond, U.S. Patent Application entitled "Method and System for Removing Fluid From a Subterranean Zone Using an Enlarged Cavity", U.S. Appl. No. 10/264,535, filed Oct. 3, 2002.

Zupanick, U.S. Patent Application entitled "Method of Drilling Lateral Wellbores From a Slant Wall Without Utilizing a Whipstock," U.S. Appl. No. 10/267,426, filed Oct. 8, 2002.

Rial, U.S. Patent Application entitled "Method and System for Controlling the Production Rate Of Fluid From A Subterranean Zone To Maintain Production Bore Stability In The Zone," U.S. Appl. No. 10/328/408, filed Dec. 23, 2002.

Zupanick, U.S. Patent Application entitled "Method and System for Recirculating Fluid in a Well System," U.S. Appl. No. 10/457,103, filed Jun. 5, 2003.

Zupanick, U.S. Patent Application entitled "Method and System for Accessing Subterranean Deposits from the Surface and Tools Therefor," U.S. Appl. No. 10/630,345, filed Jul. 29, 2003.

Pauley, Steven, U.S. Patent Application entitled "Multi–Purpose Well Bore and Method for Accessing a Subterranean Zone From the Surface," U.S. Appl. No. 10/715,300, filed Nov. 17, 2003.

Seams, Douglas, U.S. Patent Application entitled "Method and System for Extraction of Resources from a Subterranean Well Bore," filed Nov. 26, 2003, U.S. 10/723,322.

Zupanick, U.S. Patent Application entitled "Slant Entry Well System and Method," filed Dec. 31, 2003, U.S. Appl. 10/749,884.

Zupanick, U.S. Patent Application entitled "Method and System for Accessing a Subterranean Deposits from the Surface," U.S. Appl. No. 10/761,629, filed Jan. 20, 2004.

Zupanick, U.S. Patent Application entitled "Method and System for Testing Partially Formed Hydrocarbon Well for Evaluaton and Well Planning Refinement," U.S. Appl. No. 10/769,221, filed Jan. 30, 2004.

Platt, "Method and System for Lining Multilateral Wells," U.S. Appl. 10/772,841, filed Feb. 5, 2004.

Zupanick, "Three–Dimentsional Well System For Accessing Subterranean Zones," filed Feb. 11, 2004, U.S. Appl. 10/777,503.

Zupanick, "System And Method For Directional Drilling Utilizing Clutch Assembly," U.S. Appl. No. 10/811,118, filed,Mar. 25, 2004.

Zupanick, "Slot Cavity," U.S. Appl. No. 10/419,529, filed, Apr. 21, 2003.

Zupanick, "System and Method for Multiple Wells from a Common Surface Location," U.S. Appl. No. 10/788,694, filed Feb. 27, 2004.

McCray and Cole, "Oil Well Drilling and Technology," *University of Oklahoma Press*, pp. 315–319, 1959.

Berger and Anderson, "Modern Petroleum;" *PennWell Books*, pp. 106–108, 1978.

Howard L. Hartman, et al.; "SME Mining Engineering Handbook;" *Society for Mining, Metallurgy, and Exploration, Inc.*; pp. 1946–1950, 2nd Edition, vol. 2, 1992.

Dave Hassan, Mike Chernichen, Earl Jensen, and Morley Frank; "Multi–lateral technique lowers drilling costs, provides environmental benefits", *Drilling Technology*, pp. 41–47, Oct. 1999.

Joseph A. Zupanick; Declaration of Experimental Use with attached Exhibits A–D, dated Nov. 12, 2000, 308 total pages.

Gopal Ramaswamy, "Production History Provides CBM Insights, " *Oil & Gas Journal*, pp. 49, 50 and 52, Apr. 2, 2001.

Weiguo Chi and Luwu Yang, "Feasibility of Coalbed Methane Exploitation in China," *Horizontal Well Technology*, p. 74, Sep. 2001.

Nackerud Product Description, *Harvest Tool Company,LLC*, 1 page, Received Sep. 27, 2001.

U.S. Appl. No. 09/444,029, entitled "Method and System for Accessing Subterranean Deposits From The Surface," filed Nov. 19, 1999, 52 pages.

U.S. Appl. No. 09/773,217, entitled "Method and System for Accessing Subterranean Zones From a Limited Surface Area", filed Jan. 30, 2001, 72 pages.

U.S. Appl. No. 09/769,098, entitled "Method and System for Enhanced Access to a Subterranean Zone," filed Jan. 24, 2001, 65 pages.

U.S. Appl. No. 10/142,817, entitled "Method and System for Underground Treatment of Materials," filed May 8, 2002, 54 pgs., May 2, 2002.

U.S. Appl. No. 09/774,996, entitled "Method and System for Accessing a Subterranean Zone From a Limited Surface Area," filed Jan. 30, 2001, 67 pages.

U.S. Appl. No. 09/932,482, entitled "Single–Blade Underreamer," filed Aug. 17, 2001, 38 pages.

U.S. Appl. No. 09/929,551, entitled "Pantograph Underreamer," filed Aug. 13, 2001, 27 pages.

U.S. Appl. No. 10/046,001, entitled "Method and System for Management of By–Products From Subterranean Zones," filed Oct. 19, 2001. 42 pages.

U.S. Appl. No. 09/932,487, entitled "Multi–Blade Underreamer," filed Aug. 17, 2001, 38 pages.

U.S. Appl. No. 09/789,956, entitled "Method and System for Accessing Subterranean Deposits From The Surface," filed Feb. 20, 2001, 54 pages.

U.S. Appl. No. 09/788,897, entitled "Method and System for Accessing Subterranean Deposits From The Surface," filed Feb. 20, 2001, 54 pages.

U.S. Appl. No. 09/791,033, entitled "Method and System for Accessing Subterranean Deposits From The Surface," filed Feb. 20, 2001, 50 pages.

U.S. Appl. No. 09/885,219, entitled "Method and System for Accessing Subterranean Deposits From The Surface," filed Jun. 20, 2001, 52 pages.

U.S. Appl. No. 09/929,175, entitled "Pantograph Underreamer," filed Aug. 13, 2001, 24 pages.

U.S. Appl. No. 09/929,568, entitled "Pantograph Underreamer," filed Aug. 13, 2001, 25 pages.

U.S. Appl. No. 10/003,917, entitled "Method and System for Surface Production of Gas from a Subterreanean Zone," filed Nov. 1, 2001, 75 pages.

U.S. Appl. No. 10/004,316, entitled "Slant Entry Well System and Method," filed Oct. 30, 2001, 35 pages.

U.S. Appl. No. 10/165,627, entitled "Method and System for Accessing Subterranean Deposits from the Surface," filed Jun. 7, 2002, 26 pages.

U.S. Appl. No. 10/165,625, entitled "Method and System for Accessing Subterranean Deposits from the Surface," filed Jun. 7, 2002, 26 pages.

U.S. Appl. No. 10/079,444, entitled "Pantograph Underreamer," filed Feb. 19, 2002, 32 pages.

Gopal Ramaswamy, "Advances Key For Coalbed Methane," *The American Oil & Gas Reporter*, pp. 71 & 73, Oct. 2001.

Arfon H. Jones et al., A Review of the Physical and Mechanical Properties of Coal with Implications for Coal–Bed Methane Well Completion and Production, *Rocky Mountain Association of Geologists*, pp. 169–181, 1998.

Joseph C. Stevens, Horizontal Applications For Coal Bed Methane Recovery, *Strategic Research Institute*, pp. 1–10 (slides), Mar. 25, 2002.

U.S. Patent Application Serial No. __, entitled "Wellbore Plug System and Method," filed Jul. 12, 2002, (21 pgs. spec./4 pgs. drawings).

Notification of Transmittal of the International Search Report or the Declaration (PCT Rule 44.1) mailed Nov. 5, 2003 (8 pages) re International Application No. PCT/US 03/21627, Nov. 7, 2003.

Notification of Transmittal of the International Search Report or the Declaration (PCT Rule 44.1) mailed Nov. 4, 2003 (7 pages) re International Application No. PCT/US 03/21628, Nov. 7, 2003.

Notification of Transmittal of the Interntional Search Report or the Declaration (PCT Rule 44.1) mailed Nov. 6, 2003 (8 pages) re International Application No. PCT/US 03/21626, filed Jul. 11, 2003.

Notification of Transmittal of the International Search Report or the Declaration (PCT Rule 44.1) mailed Nov. 5, 2003 (8 pages) re International Application No. PCT/US 03/21627, filed Jul. 11, 2003.

Notification of Transmittal of the International Search Report or the Declaration (PCT Rule 44.1) mailed Nov. 4, 2003 (7 pages) re International Application No. PCT/US 03/21628, filed Jul. 11, 2003.

Notification of Transmittal of the International Search Report or the Declaration (PCT Rule 44.1) mailed Dec. 5, 2003 (8 pages) re International Application No. PCT/US 03/21750, filed Jul. 11, 2003.

Examiner of Record, Office Action Response regarding the Interpretation of the three Russian Patent Applications listed above under Foreign Patent Documents (9 pages), Date Unknown.

B. Gotas et al., "Performance of Openhole Completed and Cased Horizontal/Undulating Wells in Thin–Bedded, Tight Sand Gas Reservoirs," Society of Petroleum Engineers, Inc., Oct. 17 through Oct. 19, 2000, pp. 1–7.

R. Sharma, et al., "*Modelling of Undulating Wellbore Trajectories, The Journal of Canadian Petroleum Technology*", XP–002261908, Oct. 18–20, 1993, pp 16–24, Oct. 18–20, 2000.

E. F. Balbinski et al., "*Prediction of Offshore Viscous Oil Field Performance*," European Symposium on Improved Oil Recovery, Aug. 18–20, 1999, pp. 1–10, Aug. 18, 1000–Aug. 20, 2000.

Notification of Transmittal of the International Search Report or the Declaration (PCT Rule 44.1) mailed Dec. 19, 2003 (6 pages) re International Application No. PCT/US 03/28137, filed Sep. 9, 2003.

Ian D. Palmer et al., "*Coalbed Methane Well Completions and Stimulations*", Chapter 14, pp. 303–339, Hydrocarbons from Coal, Published by the American Association of Petroleum Geologists, 1993.

Chi, Weiguo, "*A Feasible Discussion on Exploitation Coalbed Methane through Horizontal Network Drilling in China*", SPE 64709, Society of Petroleum Engineers (SPE International), 4 pages, Nov. 7, 2000.

Chi, Weiguo, "*Feasibility of Coalbed Methane Exploitation in China*", synopsis of paper SPE 64709, 1 page, Nov. 7, 2000.

Notification of Transmittal of the International Search Report or the Declaration (PCT Rule 44.1) (3 pages) and International Search Report (6 pages) re International Application No. PCT/US 03/28138 mailed Feb. 9, 2004.

Notification of Transmittal of the International Search Report or the Declaration (PCT Rule 44.1) (3 pages) and International Search Report (6 pages) re International Application No. PCT/US–03/30126 mailed Feb. 27, 2004.

Gardes, Robert, "*A New Direction in Coalbed Methane and Shale Gas Recovery*," (to the best of Applicant's recollection, first received at The Canadian Institute Coalbed Methane Symposium conference on Jun. 16 and Jun. 17, 2002), 1 page of conference flyer, 6 pages.

Gardes, Robert, "*Under–Balance Multi–Lateral Drilling for Unconventional Gas Recovery*," (to the best of Applicants' recollection, first received at The Unconventional Gas Revolution conference on Dec. 9, 2003, 4 pages of conference flyer, 33 pages.

Boyce, Richard G., "*High Resolution Selsmic Imaging Program for Coalbed Methane Development*," (to the best of Applicant's recollection, first received at The Unconventional Gas Revolution conference on Dec. 10, 2003), 4 pages of conference flyer, 24 pages.

Mazzella, Mark, et al., "*Well Control Operations on a Multiwell Platform Blowout*," WorldOil.com —Online Magazine Article, vol. 22, Part 1—pp. 1–7, Jan. 2001, and Part II, Feb. 2001, pp. 1–13.

Vector Magnetics, LLC, Case History, California, May 1999, "*Successful Kill of a Surface Blowout*," 1999, pp. 1–12.

Cudd Pressure Control, Inc, "*Successful Well Control Operations—A Case Study: Surface and Subsurface Well Intervention on a Multi–Well Offshore Platform Blowout and Fire*," 2000, pp. 1–17, http://www.cuddwellcontrol.com/literature/successful/successful_well.htm.

Purl, R., et al., "*Damage to Coal Permeability During Hydraulic Fracturing*," SPE 21813, 1991, pp. 109–115.

U.S. Dept. of Energy—Office of Fossil Energy, "*Multi–Seam Well Completion Technology: Implications for Powder River Basin Coalbed Methane Production*," pp. 1–100, A–1 through A–10, Sep. 2003.

U.S. Dept. of Energy—Office of Fossil Energy, "*Powder River Basin Coalbed Methane Development and Produced Water Management Study*," pp. 1–111, A–1 through A–14, Nov. 2002.

Fletcher, Sam, "*Anadarko Cuts Route Under Canadian River Gorge*," Oil & Gas Journal, pp. 28–30, Jan. 5, 2004.

Kalinin, et al., Translation of Selected Pages from Ch. 4, Sections 4.1, 4.4, 4.4.1, 4.4.3, 11.2.2, 11.2.4 and 11.4, "*Drilling Inclined and Horizontal Well Bores*," Moscow, Nedra Publishers, 15 pages, 1997.

Kalinin, et al., Translation of Selected Pages from Ch. 4, Sections 4.2 (p. 135), 10.1 (p. 402), 10.4 (pp. 418–419), "*Drilling Inclined and Horizontal Well Bores*," Moscow, Nedra Publishers, 4 pages, 1997.

Arens, V. Zh., Translation of Selected Pages, "*Well–Drilling Recovery of Minerals*," Moscow, Nedra Publishers, 7 pages, 1986.

Field, T.W., "*Surfactants to In–seam Drilling—The Australian Experience*," 10 pages, Undated.

Drawings included in CBM well permit issued to CNX stamped Apr. 15, 2004 by the West Virginia Department of Environmental Protection (4 pages).

Website of Mitchell Drilling Contractors, "*Services: Dymaxion—Surface to In–seam*," http://www.mitchell drilling.com/dymaxion.htm, printed as of Jun. 17, 2004, 4 pages.

Website of CH4, "About Natural Gas—Technology," http://www.ch4.com.au/ng_technology.html, copyright 2003, printed as of Jun. 17, 2004, 4 pages.

Thomson, et al., "*The Appliation of Medium Radius Directional Drilling for Coal Bed Methane Extraction*," Lucas Technical Paper, copyright 2003, 11 pages.

U.S. Department of Energy, DE–FC26–01NT41148, "*Enhanced Coal Bed Methane Production and Sequestration of CO2 in Unmineable Coal Seams*" for Consol, Inc., accepted Oct. 1, 2001, 48 pages, including cover page.

U.S. Department of Energy, "Slant Hole Drilling," Mar. 1999, 1 page.

Notification of Transmittal of the International Search Report or the Declaration (PCT Rule 44.1) (3 pages) and International Search Report (7 pages) re International Application No. PCT/US 03/04771 mailed Jul. 4, 2003.

Notification of Transmittal of the International Search Report or the Declaration (PCT Rule 44.1) (3 pages) and International Search Report (5 pages) re International Application No. PCT/US 03/21891 mailed Nov. 13, 2003.

Desai, Praful, et al., "Innovative Design Allows Construction of Level 3 or Level 4 Junction Using the Same Platform," SPE/Petroleum Society of CIM/CHOA 78965, Canadian Heavy Oil Association, 2002, pp. 1–11.

ByBee, Karen, "Advanced Openhole Multilaterals," Horizontal Wells, Nov. 2002, pp. 41–42.

Bybee, Karen, "A New Generation Multilateral System for the Troll Olje Field," Multilateral/Extended Reach, Jul. 2002, pp. 50–51.

Emerson,, A.B., et al., "Moving Toward Simpler, Highly Functional Multilateral Completions," Technical Note, Journal of Canadian Petroleum Technology, May 2002, vol. 41, No. 5, pp. 9–12.

Moritis, Guntis, "*Complex Well Geometries Boost Orinoco Heavy Oil Producing Rates*," XP–000969491, Oil & Gas Journal, Feb. 28, 2000, pp. 42–46.

Themig, Dan, "*Multilateral Thinking*," New Technology Magazine, Dec. 1999, pp. 24–25.

Smith, R.C., et al., "*The Lateral Tie–Back System: The Ability to Drill and Case Multiple Laterals*," IADC/SPE 27436, Society of Petroleum Engineers, 1994, pp. 55–64, plus Multilateral Services Profile (1 page) and Multilateral Services Specifications (1 page).

Notification of Transmittal of the International Search Report or the Declaration (PCT Rule 44.1) (3 pages) and International Search Report (4 pages) re International Application No. PCT/US 03/13954 mailed Sep. 1, 2003.

Logan, Terry L., "*Drilling Techniques for Coalbed Methane*" Hydrocarbons From Coal, Chapter 12, Cover Page, Copyright Page, pp. 269–285, Copyright 1993).

Hanes, John, "*Outburst in Leichhrdt Colliery: Lessons Learned*," International Symposium–Cum–Workshop on Management and Control of High Gas Emissions and Outbursts in Underground Coal Mines, Wollongong, NSW, Australia, Mar. 20–24, 1995, Cover page, pp. 445–449.

Williams, Ray, et al., "*Gas Reservoir Properties for Mine Gas Emission Assessment*," Bowen Basin Symposium 2000, pp. 325–333.

Brown, K., et al., "*New South Wales Coal Seam Methane Potential*," Petroleum Bulletin 2, Department of Mineral Resources, Discovery 2000, Mar. 1996, pp. i–viii, 1–96.

Fipke, S., et al., "*Economical Multilateral Well Technology for Canadian Heavy Oil*," Petroleum Society, Canadian Institute of Mining, Metallurgy & Petroleum, Paper 2002–100, to be presented in Calgary Alberta, Jun. 11–13, 2002, pp. 1–11.

PowerPoint Presentation entitled, "Horizontal Coalbed Methane Wells," by Bob Stayton, Computalog Drilling Services, date is believed to have been in 2002 (39 pages).

Denney, Dennis, "*Drilling Maximum–Reservoir–Contact Wells in the Shaybah Field*," SPE 85307, pp. 60, 62–63, Oct. 20, 2003.

Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.

Brunner, D.J. and Schwoebel, J.J., "Directional Drilling for Methane Drainage and Exploration in Advance of Mining," REI Drilling Directional Underground, World Coal, 1999, 10 pages.

Thakur, P.C., "A History of Coalbed Methane Drainage From United States Coal Mines," 2003 SME Annual Meeting, Feb. 24–26, Cincinnati, Ohio, 4 pages.

U.S. Climate Change Technology Program, "Technology Options for the Near and Long Term," 4.1.5 Advances in Coal Mine Methane Recovery Systems, pp. 162–164.

Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.

Gardes, Robert, "Multi–Seam Completion Technology," Natural Gas Quarterly, E&P, Jun. 2004, pp. 78–81.

Baiton, Nicholas, "Maximize Oil Production and Recovery," Verizontal Brochure, received Oct. 2, 2002, 4 pages.

Dreiling, Trim, McClelland, M.L. and Bilyeu, Brad, "Horizontal & High Angle Air Drilling in the San Juan Basin, New Mexico," Dated on or about Mar. 6, 2003, pp. 1–11.

Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94–09, paper to be presented Mar. 20–23, 1994, Calgary, Canada, 10 pages.

Fischer, Perry, A., "What's Happening in Production," World Oil, Jun. 2001, p. 27.

Website of PTTC Network News Vol. 7, 1st Quarter 2001, Table of Contents, http://www.pttc.org/,./news/v7n1nn4.htm printed Apr. 25, 2003, 3 pages.

Cox, Richard J.W., "Testing Horizontal Wells While Drilling Underbalanced," Delft University of Technology, Aug. 1998, 68 pages.

McLennan, John, et al., "Underbalanced Drilling Manual," Gas Research Institute, Chicago, Illinois, GRI Reference No. GRI–97/0236, copyright 1997, 502 pages.

The Need for a Viable Multi–Seam Completion Technology for the Powder River Basin, Current Practice and Limitations, Gardes Energy Services, Inc., Believed to be 2003 (8 pages).

Joseph A. Zupanick et al., U.S. Appl. No. 10/123,561, entitled "Method and System for Accessing Subterranean Zones From a Limited Surface," filed Apr. 15, 2002, 49 pages (067083.0193).

Joseph A. Zupanick et al., U.S. Appl. No. 10/123,556, entitled "Method and System for Accessing Subterranean Zones From a Limited Surface," filed Apr. 15, 2002, 49 pages (067083.0194).

Joseph A. Zupanick, U.S. Appl. No. 10/188,141, entitled, "Method and System for Accessing a Subterranean Zone From a Limited Surface", filed Jul. 1, 2002, 46 pages (067083.0201).

Joseph A. Zupanick, U.S. Appl. No. 10/194,366, entitled, "Undulating Well Bore", filed Jul. 12, 2002, 36 pages (067083.0176).

R.J. "Bob" Stayton, "Horizontal Wells Boost CBM Recovery", Special Report: Horizontal & Directional Drilling, *The American Oil & Gas Reporter*, pp. 71–75, Aug. 2002.

Kelley et al., U.S. Appl. No. US 2002/0074122 A1 Method and Apparatus for Hydrocarbon Subterranean Recover, Jun. 20, 2002.

Susan Eaton, "Reversal of Fortune", New Technology Magazine, pp. 30–31, Sep. 2002.

James Mahony, "A Shadow of Things to Come", New Technology Magazine, pp. 28–29, Sep. 2002.

Documents Received from Third Party, Great Lakes Directional Drilling, Inc., (12 pages), Received Sep. 12, 2002.

Robert W. Taylor and Richard Russell, Multilateral Technologies Increase Operational Efficiencies in Middle East, Oil & Gas Journal, pp. 76–80, Mar. 16, 1998.
Adam Pasiczynk, "Evolution Simplifies Multilateral Wells", Directional Drilling, pp. 53–55, Jun. 2000.
Steven S. Bell, "Multilateral System with Full Re–Entry Access Installed", World Oil, p. 29, Jun. 1996.
P. Jackson and S. Kershaw, Reducing Long Term Methane Emissions Resulting from Coal Mining, Energy Convers. Mgmt, vol. 37, Nos. 6–8, pp. 801–806, 1996.
Pascal Breant, "Des Puits Branches, Chez Total : les puits multi drains", Total Exploration Production, pp. 1–5, Jan. 1999.
Dreilung, Tim, McClelland, M.L. and Bilyeu, Brad, "Horizontal & High Angle Air Drilling in the San Juan Basin, New Mexico, " Believed to be dated Apr. 1996, pp. 1–11.
Langley, Diane, "Potential Impact of Microholes Is Far From Diminutive," JPT Online, http://www.spe.org/spe/jpt/jps, Nov. 2004 (5 pages).
Consol Energy Slides, "Generating Solutions, Fueling Change," Presented at Appalachian E&P Forum, Harris Nesbitt Corp., Boston, Oct. 14, 2004 (29 pages).
Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518.
Schenk, Christopher J., "Geologic Definintion and Resource Assessment of Continuous (Unconventional) Gas Accumulations—the U.S. Experience," Website, http://aapg.confex.com/aapg/cairo2002/techprogram/paper_668806.htm, printed Nov. 16, 2004 (1 page).
U.S. Department of Interior, U.S. Geological Survey, "Characteristics of Discrete and Basin–Centered Parts of the lOwer Silurian Regional Oil and Gas Accumulation, Appalachian Basin: Preliminary Results From a Data Set of 25 oil and Gas Fields," U.S. Geological Survey Open–File Report 98–216, Website, http://pubs.usgs.gov/of/1998/of98–216/introl.htm, printed Nov. 16, 2004 (2 pages).
Zupanick, J., "Coalbed Methane Extraction," 28$^{th}$ Mineral Law Conference, Lexington, Kentucky, Oct. 16–17, 2003 (48 pages).
Zupanick, J., "CDX Gas—Pinnacle Project," Presentation at the 2002 Fall Meeting of North American Coal Bed Methane Forum, Morgantown, West Virginia, Oct. 30, 2002 (23 pages).
Lukas, Andrew, Lucas Drilling Pty Ltd., "Technical Innovation and Engineering Xstrata—Oaky Creek Coal Pty Limited," Presentation at Coal Seam Gas & Mine Methane Conference in Brisbane, Nov. 22–23, 2004 (51 pages).
Field, Tony, Mitchell Drilling, "Let's Get Technical—Drilling Breakthrough in Surface to In–Seam in Australia," Presentation at Coal Seam Gas & Mine Methane Conference in Brisbane, Nov. 22–23, 2004 (20 pages).
Zupanick, Joseph A, "Coal Mine Methane Drainage Utilizing Multilateral Horizontal Wells," 2005 SME Annual Meeting & Exhibit, Feb. 28–Mar. 2, 2005, Salt Lake City, Utah (6 pages).
The Official Newsletter of the Cooperative Research Centre for Mining Technology and Equipment, CMTE News 7, "Tight–Radius Drilling Clinches Award," Jun. 2001, 1 page.
Listing of 174 References received from Third Party on Feb. 16, 2005 (9 pages).
Gardes Directional Drilling, "Multiple Directional Wells From Single Borehole Developed," Reprinted from Jul. 1989 edition of Offshore, Copyright 1989 by PennWell Publishing Company (4 pages).
"Economic Justification and Modeling of Multilateral Wells," Economic Analysis, Hart's Petroleum Engineer International, 1997 (4 pages).
Mike Chambers, "Multi–Lateral Completions at Mobil Past, Present, and Future," presented at the 1998 Summit on E&P Drilling Technologies, Strategic Research Institute, Aug. 18–19, 1998 in San Antonio, Texas (26 pages).
David C. Oyler and William P. Diamond, "Drilling a Horizontal Coalbed Methane Drainage System From a Directional Surface Borehole," PB82221516, National Technical Information Service, Bureau of Mines, Pittsburgh, PA , Pittsburgh Research Center, Apr. 1982 (56 pages).
P. Corlay, D. Bossie–Cordreanu, J.C. Sabathier and E.R. Delamaide, "Improving Reservoir Management With Complex Well Architectures," Field Production & Reservoir Management, World Oil, Jan. 1997 (5 pages).
Eric R. Skonberg and Hugh W. O'Donnell, "Horizontal Drilling for Underground Coal Gasification," presented at the Eighth Underground Coal Conversion Symposium, Keystone, Colorado, Aug. 16, 1982 (8 pages).
Gamal Ismail, A.S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).
Gamal Ismail, H. El–Khatib—Zadco, Abu Dhabi UAE, "Multi–Lateral Horizontal Drilling Problems & Solutions Experienced Offshore Abu Dhabi," SPE 36252, Society of Petroleum Engineers, Oct. 1996 (12 pages).
C.M. Matthews and L.J. Dunn, "Drilling and Production Practices to Mitigate Sucker Rod/Tubing Wear–Related Failures in Directional Wells," SPE 22852, Society of Petroleum Engineers, Oct. 1991 (12 pages).
H.H. Fields, Stephen Krickovic, Albert Sainato, and M.G. Zabetakis, "Degasification of Virgin Pittsburgh Coalbed Through a Large Borehole," RI–7800, Bureau of Mines Report of Investigations/1973, United States Department of the Interior, 1973 (31 pages).
William P. Diamond, "Methane Control for Underground Coal Mines," IC–9395, Bureau of Mines Information Circular, United States Department of the Interior, 1994 (51 pages).
Technology Scene Drilling & Intervention Services, "Weatherford Moves Into Advanced Multilateral Well Completion Technology" and "Productivity Gains and Safety Record Speed Acceptance of UBS," *Reservoir Mechanics*, Weatherford International, Inc., 2000 Annual Report (2 pages).
"A Different Direction for CBM Wells," *W Magazine*, 2004 Third Quarter (5 pages).
Snyder, Robert E., "What's New in Production,"*WorldOil Magazine*, Feb. 2005, [printed from the internet on Mar. 7, 2005]http://www.worldoil.com/magazine/Magazine Detao;/as?Art Id=2507@Month Year (3 pages).
Nazzal, Greg, "Moving Multilateral Systems to the Next Level, Strategic Acquisition Expands Weatherford's Capabilities," 2000 (2 pages).
Bahr, Angie, "Methane Draining Technology Boosts Safety and Energy Production," Energy Review, Feb. 4, 2005 (2 pages).

Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.

King Robert F., "Drilling Sideways—A Review of Horizontal Well Technology and Its Domestic Application," DOE/EIA–TR–0565, U.S. Department of Energy, Apr. 1993, 30 pages.

Santos, Helio, SPE, Impact Engineering Solutions and Jesus Olaya, Ecopetrol/ICP, "*No–Damage Drilling: How to Achieve this Challenging Goal*?," SPE 77189, Copyright 2002, presented at the IADC/SPE Asia Pacific Drilling Technology, Jakarta, Indonesia, Sep. 9–11/2002, 10 pages.

Santos, Helio, SPE, Impact Engineering Solutions, "*Increasing Leaking Pressure with New Class of Drilling Fluid*," SPE 78243, Copyright 2002, presented at the SPE/ISRM Rock Mechanics Conference in Irving, Texas, Oct. 20–23/2002, 7 pages.

Franck Labenski, Paul Reid, SPE, and Helio Santos, SPE, Impact Solutions Group, "Drilling Fluids Approaches for Control of Wellbore Instability in Fractured Formations," SPE/IADC 85304, Society of Petroleum Engineers, Copyright 2003, presented at the SPE/IADC Middle East Drilling Technology Conference & Exhibition in Abu Chabi, UAE, Oct. 20–22/2003, 8 pages.

P. Reid, SPE, and H. Santos, SPE, Impact Solutions Group, "Novel Drilling, Completion and Workover Fluids for Depleted Zones: Avoiding Losses, Formation Damage and Stuck Pipe," SPE/IADC 85326, Society of Petroleum Engineers, Copyright 2003, presented at the SPE/IADC Middle East Drilling Conference & Exhibition in Abu Chabi, UAE, Oct. 20–22/2002, 9 pages.

Craig C. White and Adrian P. Chesters, NAM; Catalin D. Ivan, Sven Maikranz and Rob Nouris, M—1 L.L.C., "*Aphron–based drilling fluid: Novel technology for drilling depleted formations*," World Oil, Drilling Report Special Focus, Oct. 2003, 5 pages.

Robert E. Snyder, "Drilling Advances," World Oil, Oct. 2003, 1 page.

U.S. Environmental Protection Agency, "Directional Drilling Technology," prepared for the EPA by Advanced Resources International under Contract 68–W–00–094, Coalbed Methane Outreach Program (CMOP), Website: http://search.epa.gov/s97is.vts, printed Mar. 17, 2005, 13 pages.

"Meridian Tests New Technology," Western Oil World, Jun. 1990, Cover, Table of Contents and p. 13.

Clint Leazer and Michael R. Marquez, "Short–Radius Drilling Expands Horizontal Well Applications," Petroleum Engineer International, Apr. 1995, 6 pages.

Terry R. Logan, "Horizontal Drainhole Drilling Techniques Used in Rocky Mountains Coal Seams," Geology and Coal–Bed Methan Resources of the Northern San Juan Basin, Colorado and New Mexico, Rocky Mountain Association of Geologists, Coal–Bed Methane, San Juan Basin, 1988, pp. cover, 133–142.

Daniel J. Brunner, Jeffrey J. Schwoebel, and Scott Thomson, "Directional Drilling for Methane Drainage & Exploration in Advance of Mining," Website: http://www.adminingtech.com.au/Paper4.htm, printed Apr. 6, 2005, Copyright 1999, Last modified Aug. 7, 2002 (8 pages).

Karen Bybee, highlights of paper SPE 84424, "Coalbed–Methane Reservoir Simulation: An Evolving Science," by T.L. Hower, JPT Online, Apr. 2004, Website: http://www.spe.org/spe/jpt/jsp/jptpapersynopsis/0,2439,1104 11038 2354946 2395832.00.html, printed Apr. 14, 2005, 4 pages.

Kevin Meaney and Lincoln Paterson, "Relative Permeability in Coal," SPE 36986, Society of Petroleum Engineers, Copyright 1996, pp. 231–236.

Calendar of Events –Conference Agenda, Fifth Annual Unconventional Gas and Coalbed Methane Conference, Oct. 22–24, 2003, in Calgary Alberta, Website: http://www.csug.ca/cal/calc0301a.html, printed Mar. 17, 2005, 5 pages.

Tom Engler and Kent Perry, "Creating a Roadmap for Unconventional Gas R&D," Gas TIPS, Fall 2002, pp. 16–20.

CSIRO Petroleum –SIMEDWin, "Summary of SIMEDWin Capabilities," Copyright 1997–2005, Website: http://www.dpr.csiro.au/ourcapabilities/petroleumgeoengineering/reservoirengineering/projects/simedwin/assets/simed/index.html, printed Mar. 17, 2005, 10 pages.

Solutions From the Field, "Coalbed Methane Resources in the Southeast," Copyright 2004, Website: http://www.pttc.org/solutions/sol 2004/537.htm, printed Mar. 17, 2005, 7 pages.

Jeffrey R. Levine, Ph.D., "Matrix Shrinkage Coefficient," Undated, 3 pages.

G. Twombly, S.H. Stepanek, T.A. Moore, Coalbed Methane Potential in the Waikato Coalfield of New Zealand: A Comparison With Developed Basins in the United States, 2004 New Zealand Petroleum Conference Proceedings, Mar. 7–10, 2004, pp. 1–6.

R.W. Cade, "Horizontal Wells: Development and Applications," Presented at the Fifth International Symposium on Geophysics for Mineral, Geotechnical and Environmental Applications, Oct. 24–28, 1993 in Tulsa, Oklahoma, Website: http://www.mgls.org/93Sym/Cade/cade.html, printed Mar. 17, 2005, 6 pages.

Solutions From the Field, "Horizontal Drilling, A Technology Update for the Appalachian Basin," Copyright 2004, Website: http://www.pttc.org/solutions/sol 2004/535.htm, printed Mar. 17, 2005, 6 pages.

R. Purl, J.C. Evanoff and M.L. Brugler, "Measurement of Coal Cleat Porosity and Relative Permeability Characteristics," SPE 21491, Society of Petroleum Engineers, Copyright 1991, pp. 93–104.

Peter Jackson, "Drilling Technologies for Underground Coal Gasification," IMC Geophysics Ltd., International UCG Workshop –Oct. 2003 (20 pages).

Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/002162 mailed Apr. 22, 2005.

Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/005289 mailed Apr. 29, 2005.

Notification of Transmittal of the International Search Report and the Written Opinion of the International Searching Authority, or the Declaration (3 pages) International Search Report (5 pages) re International Application No. PCT/US2004/036616 mailed Feb. 24, 2005.

Notification of Transmittal of International Preliminary Examination Report (1 page) and International Preliminary Examination Report (3 pages) for International Application No. PCT/US03/13954 mailed Apr. 14, 2005.

Notification of Transmittal of International Preliminary Examination Report (1 page) and International Preliminary Examination Report (5 pages) mailed Jan. 18, 2005 and Written Opinion (8 pages) mailed Aug. 25, 2005 for International Application No. PCT/US03/30126.

Notification of Transmittal of the International Search Report or the Declaration (3 pages) and International Search Report (5 pages) mailed Nov. 10, 2000 for International Application No. PCT/US99/27494.

Notification of Transmittal of International Preliminary Examination Report (1 page) and International Preliminary Examination Report (6 pages) mailed Apr. 2, 2001 and Written Opinion mailed Sep. 27, 2000 for International Application No. PCT/US99/27494.

Notification of Transmittal of the International Search Report or the Declaration (3 pages) and International Search Report (5 pages) mailed Jun. 6, 2002 for International Application No. PCT/US02/02051.

* cited by examiner

FIG. 4
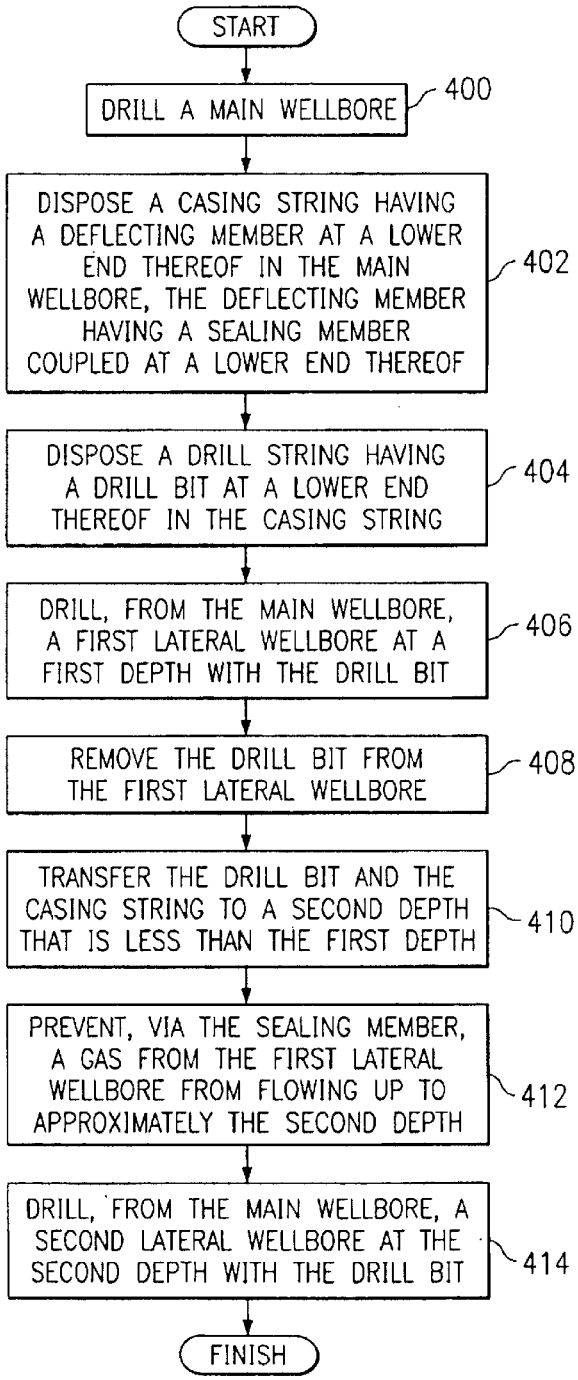
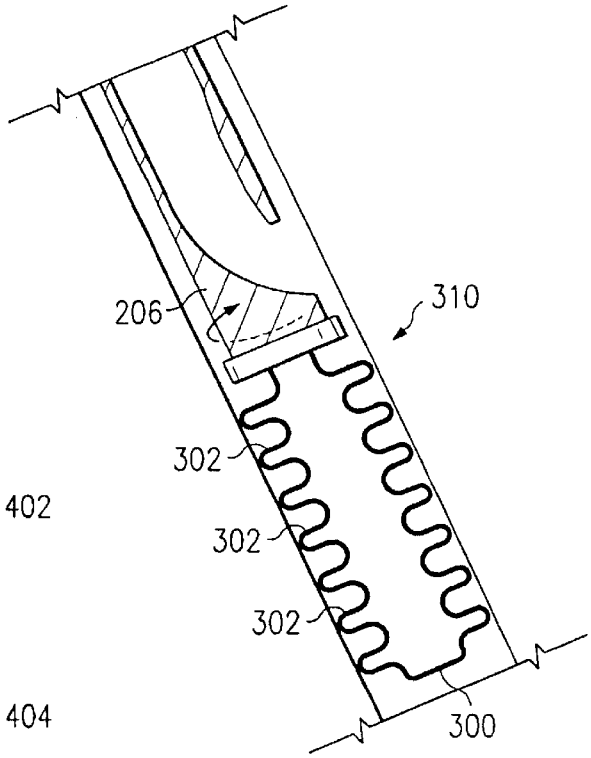
FIG. 3

WELLBORE SEALING SYSTEM AND METHOD

TECHNICAL FIELD OF THE INVENTION

The present invention relates generally to systems and methods for the recovery of subterranean resources and, more particularly, to a wellbore sealing system and method.

BACKGROUND OF THE INVENTION

Subterranean deposits of coal (typically referred to as "coal seams") often contain substantial quantities of entrained methane gas. Limited production and use of methane gas from coal seams has occurred for many years because substantial obstacles have frustrated extensive development and use of methane gas deposits in coal seams.

In recent years, various methods have been used to retrieve methane gas deposits from coal seams. One such method is the use of underbalanced drilling using a dual-string technique. As an example of this method, a fluid such as drilling fluid is circulated down a drill string, while another relatively light fluid such as air or nitrogen is circulated down an annulus formed between an outside surface of a drill string and an inside surface of a casing string. A mixture of these fluids is retrieved from an annulus formed between an outer surface of the casing string and an inside surface of the wellbore after mixing with a gas or other fluid obtained from a lateral wellbore being drilled. The purpose of the lighter fluid is to lighten the weight of the drilling fluid such that the hydrostatic head of the drilling fluid does not force the drilling fluid into the subterranean formation and create detrimental effects.

SUMMARY OF THE INVENTION

The present invention provides a wellbore sealing system and method that substantially eliminates or reduces the disadvantages and problems associated with previous systems and methods.

In accordance with one embodiment of the present invention, a method for drilling wellbores includes drilling a main wellbore and disposing a casing string in the main wellbore. The casing string has a deflecting member and a sealing member coupled thereto. The method further includes disposing a drill string having a drill bit coupled at a lower end thereof in the casing string and drilling, from the main wellbore, a first lateral wellbore at a first depth with the drill bit. The method further includes removing the drill bit from the first lateral wellbore, transferring the casing string and the drill bit to a second depth that is higher than the first depth, drilling, from the main wellbore, a second lateral wellbore at the second depth with the drill bit, and preventing, using the sealing member, a fluid from the first lateral wellbore from flowing above approximately the second depth while drilling the second lateral wellbore.

According to another embodiment of the present invention, a system for drilling wellbores includes a casing string, a deflecting member coupled to the casing string, and a sealing member coupled to the deflecting member. The sealing member is adapted to seal a wellbore into which the casing string is inserted such that a fluid existing in the wellbore below the sealing member is prevented from flowing upward past the sealing member.

Some embodiments of the present invention may provide one or more technical advantages. These technical advantages may include more efficient drilling and production of methane gas and greater reduction in costs and problems associated with other drilling systems and methods. For example, there may be less damage to lateral wellbores because of mud or other fluids entering a lateral wellbore from the drilling of another lateral wellbore. In addition, cuttings are prevented from dropping into lower lateral wellbores while an upper lateral wellbore is being drilled. Another technical advantage includes providing a method for killing a lateral wellbore, while still being able to drill another lateral wellbore. An additional technical advantage is that underbalanced drilling may be performed along with the teachings of one embodiment of the present invention.

Other technical advantages of the present invention are readily apparent to one skilled in the art from the figures, descriptions, and claims included herein.

BRIEF DESCRIPTION OF THE DRAWINGS

For a more complete understanding of the present invention and its advantages, reference is now made to the following description taken in conjunction with the accompanying drawings, wherein like numerals represent like parts, in which:

FIG. 3 illustrates an example system for drilling lateral wellbores according to another embodiment of the present invention; and FIG. 4 is a flowchart demonstrating an example method for drilling lateral wellbores according to one embodiment of the present invention.

DETAILED DESCRIPTION OF THE INVENTION

Embodiments of the present invention and their advantages are best understood by referring now to FIGS. 1 through 4 of the drawings, in which like numerals refer to like parts.

Figure 1:
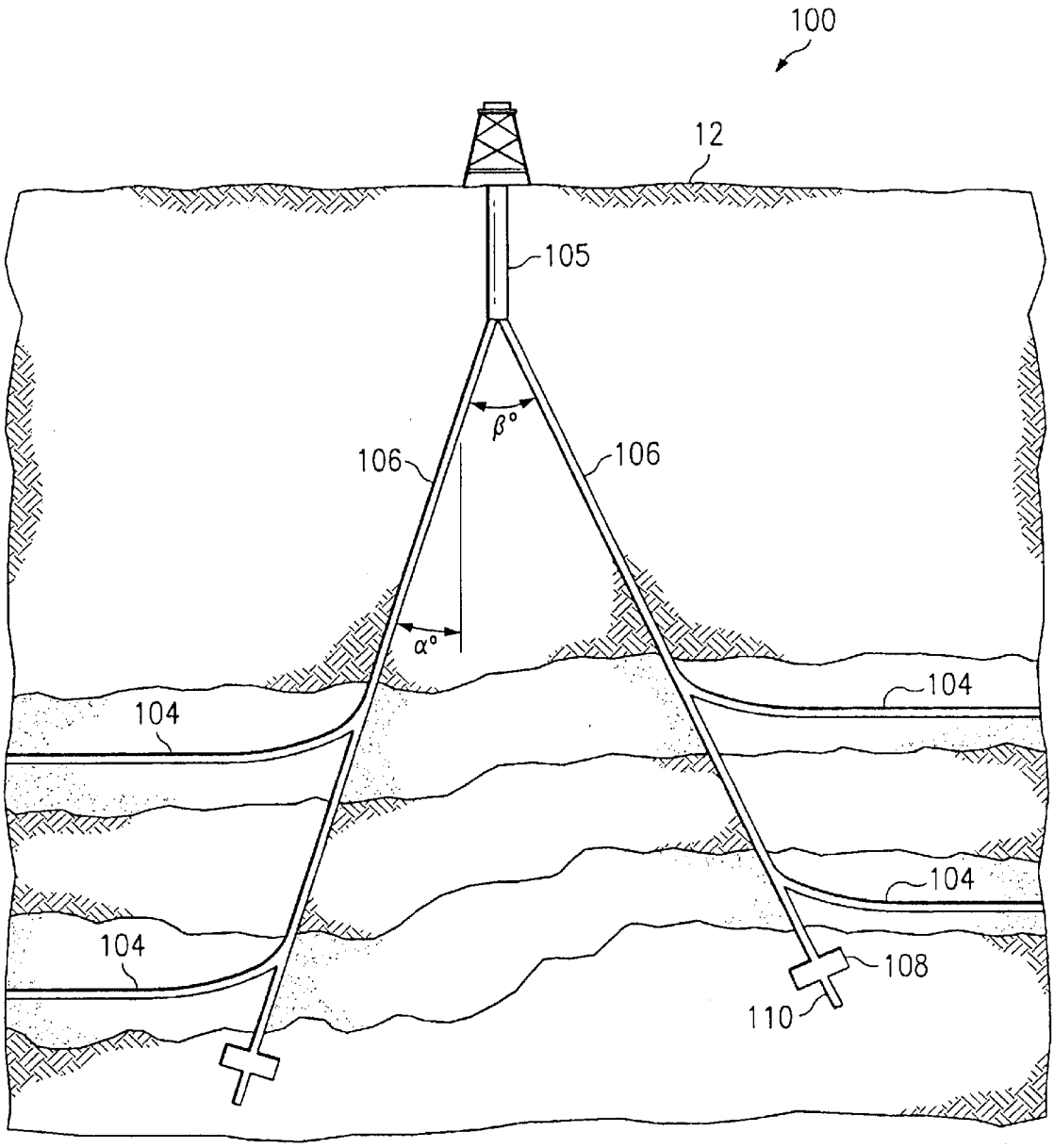
FIG. 1 is a cross-sectional view illustrating an example slant well system for production of resources from one or more subterranean zones via one or more lateral wellbores.

FIG. 1 is a cross-sectional view illustrating an example well system 100 for production of resources from one or more subterranean zones 102 via one or more lateral wellbores 104. In various embodiments described herein, subterranean zone 102 is a coal seam; however, other subterranean formations may be similarly accessed using well system 100 of the present invention to remove and/or produce water, gas, or other fluids. System 100 may also be used for other suitable operations, such as to treat minerals in subterranean zone 102 prior to mining operations, or to inject or introduce fluids, gasses, or other substances into subterranean zone 102.

Referring to FIG. 1, well system 100 includes an entry wellbore 105, two main wellbores 106, a plurality of lateral wellbores 104, a cavity 108 associated with each main wellbore 106, and a rat hole 110 associated with each main wellbore 106. Entry wellbore 105 extends from a surface 12 towards subterranean zones 102. Entry wellbore 105 is illustrated in FIG. 1 as being substantially vertical; however, entry wellbore 105 may be formed at any suitable angle relative to surface 12 to accommodate, for example, surface 12 geometries and/or subterranean zone 102 geometries.

Main wellbores 106 extend from the terminus of entry wellbore 105 toward subterranean zones 102, although main wellbores may alternatively extend from any other suitable portion of entry wellbore 105. Where there are multiple subterranean zones 102 at varying depths, as illustrated in FIG. 1, main wellbores 106 extend through the subterranean zones 102 closest to surface 12 into and through the deepest subterranean zones 102. There may be one or any number of main wellbores 106. As illustrated, main wellbores 106 are slant wells and, as such, are formed to angle away from entry wellbore 105 at an angle designated α, which may be any suitable angle to accommodate surface topologies and other factors similar to those affecting entry wellbore 105. Main wellbores 106 are formed in relation to each other at an angular separation of β degrees, which may be any suitable angle, such as 60 degrees. However, main wellbores 106 may be separated by other angles depending likewise on the topology and geography of the area and location of a targeted subterranean zone 102. Main wellbores 106 may also include cavity 108 and/or rat hole 110 located at a terminus of each wellbore 106. Main wellbore 106 may include one, both, or neither cavity 108 and rat hole 110.

Lateral wellbores 104 extend from each main wellbore 106 into an associated subterranean zone 102. Lateral wellbores 104 are shown in FIG. 1 to be substantially horizontal; however, lateral wellbores 104 may be formed in other suitable directions off of main wellbores 106 and may have a curvature associated therewith. Any suitable systems and/or methods may be used to drill lateral wellbores 104; however, a particular system for drilling lateral wellbores 104 according to one embodiment of the present invention is described below in conjunction with FIGS. 2 through 4.

Figure 2:
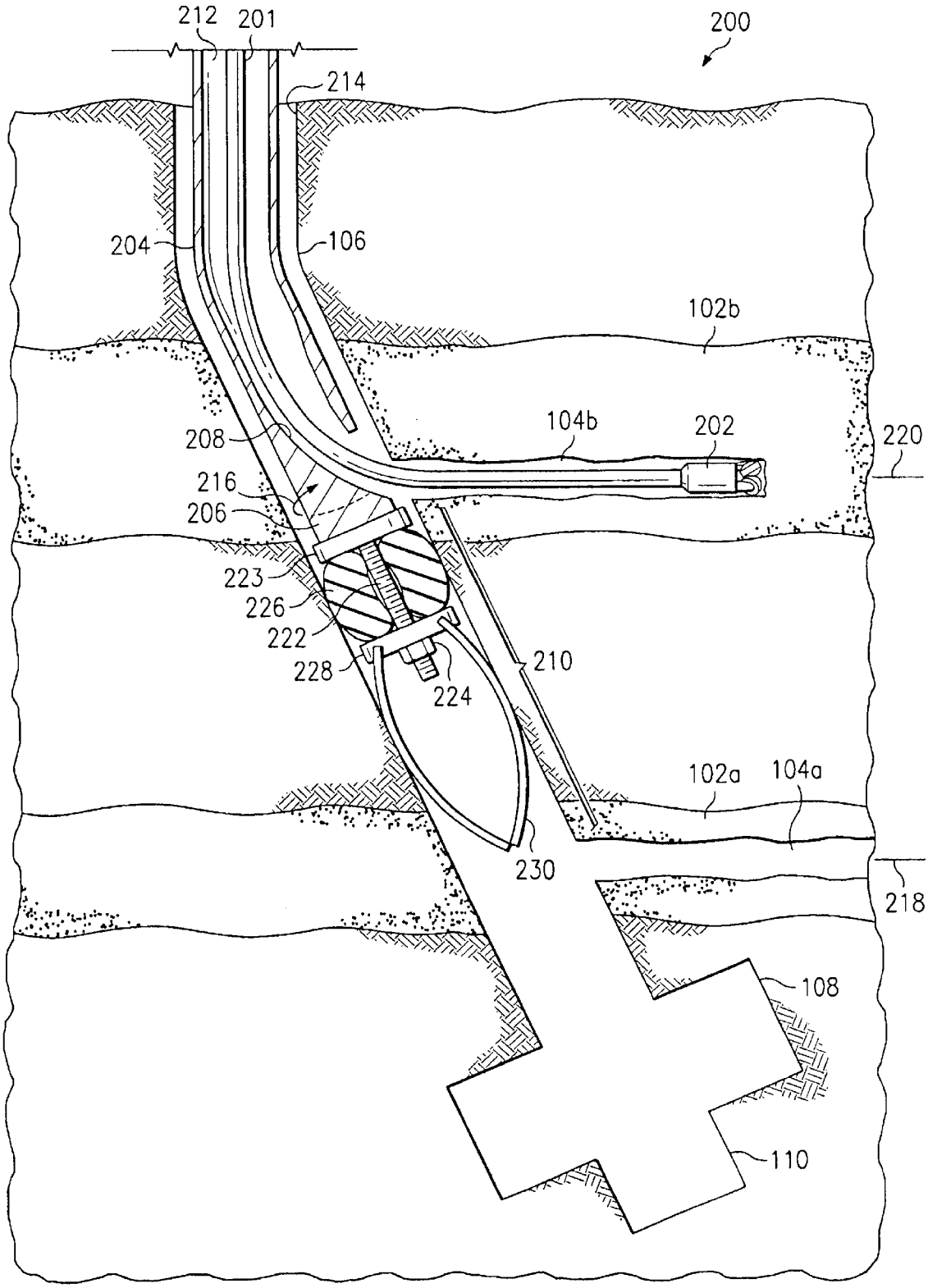
FIG. 2 illustrates an example system for drilling lateral wellbores according to one embodiment of the present invention.

FIG. 2 illustrates an example system 200 for drilling lateral wellbores 104 according to one embodiment of the present invention. As illustrated, system 200 includes a drill string 201 having a drill bit 202, a casing string 204, a deflecting member 206 having a deflecting surface 208 coupled to a lower end of casing string 204, and a sealing member 210 coupled to a lower end of deflecting member 206.

Drill string 201 may be any suitable drill string having any suitable length and diameter and any suitable drill bit 202 for the purpose of drilling lateral wellbores 104. Drill string 201 is typically a hollow conduit for allowing drilling fluids to flow therethrough. Drill bit 202 may be driven through the use of any suitable motor powered by the drilling fluid and may have any suitable configuration. To direct drill string 201 and drill bit 202 for the purpose of drilling lateral wellbore 104, deflecting surface 208 of deflecting member 206 is utilized.

Casing string 204 may be any suitable casing string having any suitable diameter that is to be inserted into main wellbore 106. Casing string 204 is adapted to rotate within main wellbore 106 as illustrated by arrow 216. An inner annulus 212 is formed between the inner surface of casing string 204 and the outer surface of drill string 201. An outer annulus 214 is also formed between an outside surface of casing string 204 and the surface of main wellbore 106. Inner annulus 212, outer annulus 214, and drill string 201 may be used to perform underbalanced drilling. As one example of underbalanced drilling, a first fluid may be circulated down drill string 201, such as drilling mud or other suitable drilling fluids. A second fluid is circulated down inner annulus 212, such as air, nitrogen, or other relatively light fluid. Both first and second fluids may be retrieved from outer annulus 214 after mixing with a gas or other fluid produced from lateral wellbore 104. The purpose of the second fluid is to lighten the weight of the first fluid such that the hydrostatic head of the first fluid does not force first fluid into the subterranean formation. As a variation, the second fluid may be circulated down outer annulus 214 and the mixture of the first and second fluids along with the gas from lateral wellbore 104 may be retrieved via inner annulus 212.

According to the teachings of the present invention, sealing member 210 is adapted to seal main wellbore 106 such that a fluid existing in main wellbore 106 below sealing member 210 is prevented from flowing upward past sealing member 210. In one embodiment of the invention, this allows the drilling of a lateral wellbore 104*a* in a subterranean zone 102*a* at a first depth 218 and then the drilling of a lateral wellbore 104*b* in a subterranean zone 102*b* at a second depth 220, while ensuring that any gas or other fluid obtained from lateral wellbore 104*a* at first depth 218 does not flow past sealing member 210 and interfere with the drilling of lateral wellbore 104*b* in subterranean zone 102*b* at second depth 220. In addition, any cuttings resulting from the drilling of lateral wellbore 104*b* are prevented from dropping into lateral wellbore 104*a*. An example sealing member 210 is illustrated in FIG. 2.

As illustrated in FIG. 2, example sealing member 210 includes a bolt 222, a nut 224, a plug 226, a washer 228, and a resilient member 230. Bolt 222 is coupled to a lower end 223 of deflecting member 206 in any suitable manner. Nut 224 is threaded on bolt 222, while washer 228 surrounds bolt 222 and is rigidly coupled to nut 224. Plug 226 surrounds bolt 222 and is disposed between washer 228 and lower end 223 of deflecting member 206.

Plug 226 is formed from any suitable material, such as an elastomer, resilient enough to be circumferentially expanded or circumferentially retracted but stiff enough to be able to prevent any gas or other fluid existing in main wellbore 106 below sealing member 210 to leak past plug 226. The circumferential expansion or retraction of plug 226 via the rotation of casing string 204 is described in more detail below. In other embodiments, plug 226 is an air-filled diaphragm formed from any suitable material.

Resilient member 230 is coupled to washer 228 in any suitable manner. Resilient member 230, which may be any suitable resilient member, such as a bow spring, is adapted to engage the wall of main wellbore 106 and apply enough force to the wall of main wellbore 106 to prevent nut 224 and washer 228 from turning while casing string 204 is rotated within main wellbore 106. Washer 228 and nut 224 are fixed to one another such that, when casing string 204 is rotated, nut 224 and washer 228 do not rotate. In this way, bolt 222 may longitudinally compress plug 226 to circumferentially expand plug 226 so that it may press against the wall of main wellbore 106 to prevent gas or other fluid from flowing upward past plug 226. Conversely, when casing string 204 is rotated in an opposite direction, then bolt 222 acts to longitudinally decompress plug 226, thereby circumferentially retracting plug 226 so that gas or other fluid may bypass plug 226.

In operation of one embodiment of system 200 of FIG. 2, main wellbore 106 is drilled via any suitable method. Casing string 204 having deflecting member 206 and sealing member 210 attached thereto is inserted into main wellbore 106. While lowering casing string 204 down main wellbore 106, plug 226 is in a circumferentially retracted position so that any air or other fluid existing at a depth below sealing member 210 may leak past plug 226. Once at a desired depth, such as first depth 218, drill string 201 is inserted within casing string 204 so that lateral wellbore 104*a* may be drilled at first depth 218. After drilling lateral wellbore 104*a* drill string 201 is retracted from lateral wellbore 104*a*. At this time, casing string 204 is rotated in a desired direction so that plug 226 may be longitudinally compressed and circumferentially expanded to press against the wall of main wellbore 106. As described above, this prevents any gas or other fluid produced from lateral wellbore 104*a* from traveling up past plug 226. Casing string 204 may then be raised to second depth 220 so that lateral wellbore 104*b* may be drilled. Lateral wellbore 104*b* may then be drilled with drill bit 202 with the assurance that sealing member 210 will prevent any gas or fluid from passing upward and causing detrimental effects. Other lateral wellbores 104 may be drilled successively at shallower depths according to a similar procedure. Many different types of sealing members 210 are contemplated by the present invention. Another example sealing member is shown below in conjunction with FIG. 3.

FIG. 3 illustrates another example sealing member 310. In one embodiment, sealing member 310 is a resilient plunger 300 formed from a suitable elastomer; however, other suitable resilient materials may be utilized. As illustrated, plunger 300 includes a plurality of ridges 302 that have an inherent stiffness to prevent gas or other fluid from a depth in main wellbore 106 below plunger 300 from leaking past plunger 300 to a higher depth (or vice versa) while a lateral wellbore 104 is being drilled. In addition, plunger 300, via ridges 302, possesses enough resiliency to allow gas or other fluid existing at a depth below plunger 300 to flow past plunger 300 to relieve any potential increasing pressure below plunger 300 when plunger 300 is inserted into main wellbore 106. Plunger 300 may have other suitable configurations and may be coupled to deflecting member 206 in any suitable manner. In other embodiments, plunger 300 is a hollow plunger having any suitable fluid therein.

Plunger 300 may also include a relief valve (not shown) that is operable to allow gas or other fluid at a depth below plunger 300 to flow to a depth above plunger 300 when a predetermined pressure is reached. Any suitable relief valve may be utilized and the relief valve may be coupled to plunger 300 in any suitable manner. The relief valve may be set to open or close at a predetermined pressure depending on the pressure expected to be encountered in main wellbore 106 below sealing member 310. A relief valve may also be utilized with sealing member 210 of FIG. 2 in a similar manner.

FIG. 4 is a flow chart demonstrating an example method of drilling lateral wellbores 104 according to one embodiment of the present invention. The method begins at step 400 where main wellbore 106 is drilled. Casing string 204 having deflecting member 206 at a lower end thereof is disposed in main wellbore 106 at step 402. Deflecting member 206 has any suitable sealing member coupled at a lower end thereof. Although example sealing members 210 and 310 are described above, any suitable sealing member may be used within the scope of the present invention.

As described above, the sealing member prevents a gas or other fluid from a lower lateral wellbore from flowing up to a higher lateral wellbore at a higher depth while drill string 201 is drilling the higher lateral wellbore. At step 404, drill string 201 having drill bit 202 is disposed in casing string 204. At step 406, a first lateral wellbore 104*a* is drilled from main wellbore 106 at first depth 218. Deflecting surface 208 of deflecting member 206 is utilized to direct drill string 201 in the desired drilling direction.

After first lateral wellbore 104*a* is drilled, drill bit 202 is removed from first lateral wellbore 104*a* at step 408. At step 410, casing string 204 and drill bit 202 are transferred to second depth 220 that is less than first depth 218. Any gas or other fluid produced from first lateral wellbore 104*a* is prevented, as denoted by step 412, from flowing up to second depth 220 by the sealing member. At step 414, second lateral wellbore 104*b* is drilled from main wellbore 106 at second depth 220 with drill bit 202. Successive lateral wellbores 104 may be drilled at successively higher depths per the above method. In lieu of a slant well system, the described example method may be used with other suitable well systems.

Although the present invention is described with several embodiments, various changes and modifications may be suggested to one skilled in the art. The present invention intends to encompass such changes and modifications as they fall within the scope of the appended claims.

What is claimed is:

1. A method for drilling wellbores, comprising:

drilling a main wellbore;

disposing a casing string in the main wellbore, the casing string having a deflecting member and a sealing member coupled thereto;

disposing a drill string having a drill bit coupled at a lower end thereof in the casing string;

drilling, from the main wellbore, a first lateral wellbore at a first depth with the drill bit;

removing the drill bit from the first lateral wellbore;

transferring the casing string and the drill bit to a second depth that is higher than the first depth;

drilling, from the main wellbore, a second lateral wellbore at the second depth with the drill bit; and preventing, using the sealing member, a fluid from the first lateral wellbore from flowing above approximately the second depth while drilling the second lateral wellbore.

2. The method of claim 1, further comprising:

removing the drill bit from the second lateral wellbore;

transferring the casing string and the drill bit to a third depth that is higher than the second depth;

drilling, from the main wellbore, a third lateral wellbore at the third depth with the drill bit; and preventing, using the sealing member, the gas from flowing above approximately the third depth while drilling the third lateral wellbore.

3. The method of claim 1, wherein drilling the main wellbore comprises drilling a slant wellbore.

4. The method of claim 1, further comprising disposing the casing string in the main wellbore such that an outer annulus is formed between a wall of the main wellbore and an outer wall of the casing string, and disposing the drill string in the casing string such that an inner annulus is formed between an inner wall of the casing string and an outer wall of the drill string.

5. The method of claim 4, further comprising:

circulating a first fluid down an inner passage of the drill string;

circulating a second fluid down the inner annulus;

regulating an amount of the second fluid to prevent the first fluid from entering a subterranean formation in which the lateral wellbore is being drilled; and retrieving a mixture of the first and second fluids and the gas from the lateral wellbore through the outer annulus.

6. The method of claim 4, further comprising:

circulating a first fluid down an inner passage of the drill string;

circulating a second fluid down the outer annulus;

regulating an amount of the second fluid to prevent the first fluid from entering a subterranean formation in which the lateral wellbore is being drilled; and retrieving a mixture of the first and second fluids and the gas from the lateral wellbore through the inner annulus.

7. The method of claim 1, wherein disposing the casing string in the main wellbore comprises lowering the casing string down the main wellbore while allowing a fluid in the main wellbore below the sealing member to flow past the sealing member.

8. The method of claim 1, wherein preventing the fluid from the first lateral wellbore from flowing above approximately the second depth while drilling the second lateral wellbore comprises longitudinally compressing a plug of the sealing member to circumferentially expand the plug such that an outer surface of the plug engages a wall of the main wellbore.

9. The method of claim 8, further comprising rotating the casing string to longitudinally compress the plug.

10. The method of claim 1, wherein preventing the fluid from the first lateral wellbore from flowing above approximately the second depth while drilling the second lateral wellbore comprises utilizing a resilient plunger as the sealing member.

11. A system for drilling wellbores, comprising:

a casing string;

a deflecting member coupled to the casing string; and a sealing member coupled to the deflecting member, the sealing member configured to seal a wellbore into which the casing string is inserted such that a fluid existing in the wellbore below the sealing member is prevented from flowing upward past the sealing member.

12. The system of claim 11, wherein the sealing member comprises a resilient plunger.

13. The system of claim 12, wherein the sealing member further comprises a relief valve operable to allow a fluid in the wellbore below the resilient plunger to flow past the resilient plunger.

14. The system of claim 11, wherein the sealing member comprises a solid plug.

15. The system of claim 14, wherein the sealing member further comprises:

a bolt to support the solid plug;

a nut coupled to the bolt;

a washer disposed between the nut and the plug; and a spring member coupled to the washer, the spring member adapted to engage a wall of the wellbore to prevent the washer from rotating when the casing string is rotated in the wellbore such that the solid plug is longitudinally compressed and circumferentially expanded to engage the wall of the wellbore.

16. The system of claim 11, wherein the sealing member comprises an air-filled diaphragm.

17. A sealing member, comprising:

a resilient plunger adapted to couple to an end of a casing string and operable to prevent a gas within a wellbore from flowing from a lower depth below the resilient plunger to a higher depth above the resilient plunger while a lateral wellbore is being drilled.

18. A sealing member, comprising:

a bolt adapted to couple to an end of a casing string;

a nut rotatably coupled to the bolt;

a washer engaged with the nut;

a plug surrounding the bolt and resting against the washer;

a spring member coupled to the washer, the spring member adapted to engage a wall of a wellbore to prevent the washer from rotating when the casing string is rotated in the wellbore such that the plug is longitudinally compressed and circumferentially expanded to engage the wall of the wellbore to prevent a gas within the wellbore from flowing from a lower depth below the plug to a higher depth above the plug while a lateral wellbore is being drilled.

19. The sealing member of claim 18, wherein the spring member is adapted to engage the wall of the wellbore to prevent the washer from rotating when the casing string is rotated in the wellbore such that the plug is longitudinally expanded and circumferentially retracted to allow a gas within the wellbore from flowing from a lower depth below the plug to a higher depth above the plug.

20. The sealing member of claim 18, wherein the plug comprises an air-filled diaphragm.

* * * * *